US009450302B2

(12) United States Patent
Lee et al.

(10) Patent No.: US 9,450,302 B2
(45) Date of Patent: Sep. 20, 2016

(54) ANTENNA MODULE

(71) Applicant: QUANTA COMPUTER INC., Tao Yuan Hsien (TW)

(72) Inventors: Chi-Hsuan Lee, Tao Yuan Hsien (TW); Pei-Ling Teng, Tao Yuan Hsien (TW); Kuo-Cheng Chen, Tao Yuan Hsien (TW)

(73) Assignee: Quanta Computer Inc., Tao Yuan Hsien (TW)

( * ) Notice: Subject to any disclaimer, the term of this patent is extended or adjusted under 35 U.S.C. 154(b) by 204 days.

(21) Appl. No.: 14/303,028

(22) Filed: Jun. 12, 2014

(65) Prior Publication Data

US 2015/0061962 A1 Mar. 5, 2015

(30) Foreign Application Priority Data

Sep. 5, 2013 (TW) ..... 102131999 A

(51) Int. Cl.

| | |
|---|---|
| ***H01Q 1/52*** | (2006.01) |
| ***H01Q 9/42*** | (2006.01) |
| ***H01Q 21/28*** | (2006.01) |
| ***H01Q 1/24*** | (2006.01) |

(52) U.S. Cl.

CPC ..... *H01Q 1/521* (2013.01); *H01Q 1/243* (2013.01); *H01Q 9/42* (2013.01); *H01Q 21/28* (2013.01)

(58) Field of Classification Search

CPC ..... H01Q 9/42; H01Q 21/28; H01Q 5/35; H01Q 1/48; H01Q 1/243; H01Q 9/521

See application file for complete search history.

(56) References Cited

U.S. PATENT DOCUMENTS

| | | | | |
|---|---|---|---|---|
| D606,058 | S | 12/2009 | Kishler | |
| 8,085,202 | B2 | 12/2011 | Ayatollahi et al. | |
| 2008/0174508 | A1* | 7/2008 | Iwai | H01Q 9/30 343/850 |
| 2013/0057438 | A1* | 3/2013 | Satou | H01Q 1/243 343/702 |
| 2013/0120201 | A1* | 5/2013 | Park | H01Q 1/48 343/749 |
| 2013/0162497 | A1* | 6/2013 | Satou | H01Q 5/35 343/853 |
| 2013/0257674 | A1* | 10/2013 | Li | H01Q 5/321 343/853 |
| 2013/0328742 | A1* | 12/2013 | Hirobe | H01Q 1/243 343/853 |
| 2014/0313089 | A1* | 10/2014 | Wu | H01Q 1/243 343/745 |
| 2015/0255864 | A1* | 9/2015 | Zhang | H01Q 7/00 343/855 |
| 2015/0295312 | A1* | 10/2015 | Lee | H01Q 1/243 343/845 |

* cited by examiner

*Primary Examiner* — Trinh Dinh

(74) *Attorney, Agent, or Firm* — McNees Wallace & Nurick LLC

(57) ABSTRACT

An antenna module includes a grounding element, first and second radiating conductors, and a decoupling unit. The grounding element has first and second grounding ends. The first radiating conductor includes a first feed-in end that is adjacent spacedly to the first grounding end and that is configured to be fed with a first RF signal. The second radiating conductor includes a second feed-in end that is adjacent spacedly to the second grounding end and that is configured to be fed with a second RF signal. The decoupling unit is connected electrically between a portion of the first radiating conductor and a portion of the second radiating conductor that are proximate to each other, and is one of a decoupling capacitor and a decoupling inductor.

2 Claims, 7 Drawing Sheets

ANTENNA MODULE

CROSS-REFERENCE TO RELATED APPLICATION

This application claims priority of Taiwanese Application No. 102131999, filed on Sep. 5, 2013.

BACKGROUND OF THE INVENTION

1. Field of the Invention

The present invention relates to an antenna module, more particularly to an antenna having a relatively small size and high isolation.

2. Description of the Related Art

Multiple-antenna system (e.g., multiple-input and multiple-output systems, MIMO systems) is generally used to improve data rate and channel capacity. However, since mobile electronic devices are made increasingly smaller, distances between multiple antennas in the same mobile electronic device are getting shorter. When two antennas are close to each other and operate at the same resonant frequency band, coupling effect between the antennas will result in low isolation therebetween, which degrades performances of the antennas.

A conventional antenna module as disclosed in U.S. Pat. No. 8,085,202 for improving isolation between two antennas is to include, on a ground plane between the antennas, an isolation element in a form of a slot for providing isolation between the two antennas. Nevertheless, the isolation element having the slot configuration may increase the size of the conventional antenna module.

Another conventional antenna module as disclosed in U.S. Pat. No. D606,058 for improving isolation between two antennas is to include a thin metal strip that is connected electrically between the two antennas. However, to precisely adjust the thin metal strip, various considerations, parameters and factors need to be taken, thereby complicating the adjustment.

SUMMARY OF THE INVENTION

Therefore, an object of the present invention is to provide an antenna module that may alleviate the above drawbacks of the prior art.

Accordingly, an antenna module of the present invention includes a grounding element, a first radiating conductor, a second radiating conductor and a decoupling unit.

The grounding element includes a first grounding end and a second grounding end.

The first radiating conductor includes a first feed-in end that is adjacent to and spaced apart from the first grounding end of the grounding element and that is configured to be fed with a first radio frequency signal.

The second radiating conductor is adjacent to and spaced from the first radiating conductor. The second radiating conductor includes a second feed-in end that is adjacent to and spaced apart from the second grounding end of the grounding element and that is configured to be fed with a second radio frequency signal.

The decoupling unit is connected electrically between a portion of the first radiating conductor and a portion of the second radiating conductor that are proximate to each other. The decoupling unit is one of a decoupling capacitor and a decoupling inductor.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
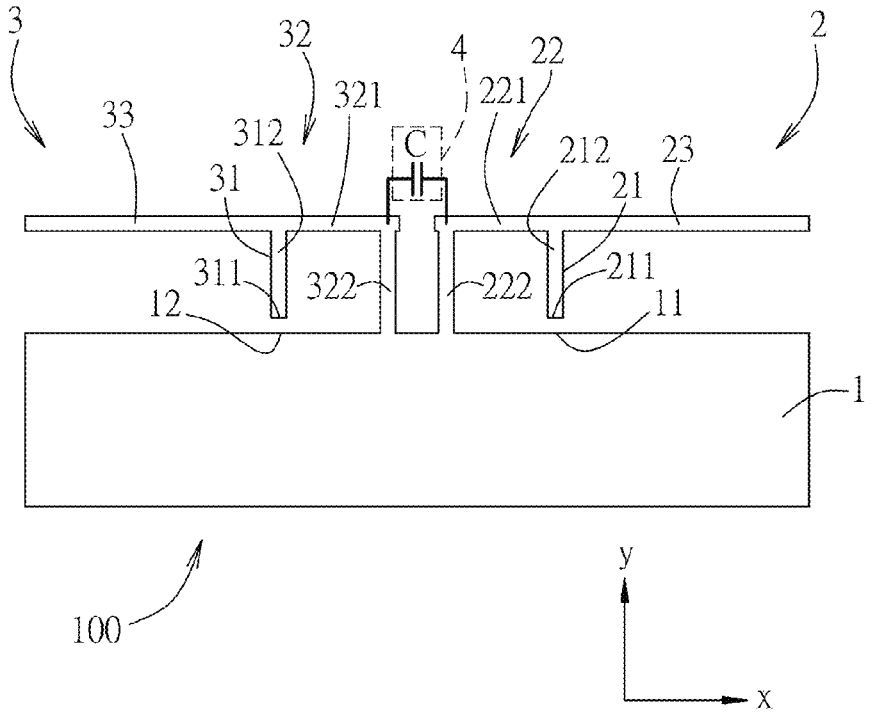
FIG. 1 is a schematic view of a first preferred embodiment of an antenna module according to the present invention.

Before the present invention is described in greater detail, it should be noted that like elements are denoted by the same reference numerals throughout the disclosure.

Referring to FIG. 1, a first preferred embodiment of an antenna module 100 according to the present invention is shown to include a grounding element 1, a first radiating conductor 2, a second radiating conductor 3 and a decoupling unit 4.

The grounding element 1 includes a first grounding end 11 and a second grounding end 12.

The first radiating conductor 2 includes a first feed-in portion 21, a first grounding portion 22 and a first radiating portion 23.

The first feed-in portion 21 is spaced apart from the grounding element 1, and includes a first feed-in end 211 and a first connecting end 212 opposite to the first feed-in end 211. The first feed-in end 211 is adjacent to the first grounding end 11 of the grounding element 1, and is configured to be fed with a first radio frequency signal.

The first grounding portion 22 is connected electrically between the grounding element 1 and the first connecting end 212 of the first feed-in portion 21. The first grounding portion 22 includes a first grounding segment 221 and a second grounding segment 222. The first grounding segment 221 is connected electrically to and extends from the first connecting end 212 of the first feed-in portion 21 in a –x direction toward the second radiating conductor 3. The second grounding segment 222 is connected electrically to the first grounding segment 221 opposite to the first connecting end 212 of the first feed-in portion 21. The second grounding segment 222 is substantially perpendicular to and extends from the first grounding segment 221 away from the first connecting end 212 in a –y direction to connect electrically with the grounding element 1.

The first radiating portion 23 is connected electrically to and extends from the first connecting end 212 of the first feed-in portion 21 in an x direction away from the first grounding portion 22.

The second radiating conductor 3 includes a second feed-in portion 31, a second grounding portion 32 and a second radiating portion 33.

The second feed-in portion 31 is spaced apart from the grounding element 1, and includes a second feed-in end 311 and a second connecting end 312 opposite to the second feed-in end 311. The second feed-in end 311 is adjacent to the second grounding end 12 of the grounding element 1, and is configured to be fed with a second radio frequency signal.

The second grounding portion 32 is connected electrically between the grounding element 1 and the second connecting end 312 of the second feed-in portion 31. The second grounding portion 32 includes a third grounding segment 321 and a fourth grounding segment 322. The third grounding segment 321 is connected electrically to and extends from the second connecting end 312 of the second feed-in portion 31 toward the first radiating conductor 2 in the x direction. The fourth grounding segment 322 is connected electrically to the third grounding segment 321 opposite to the second connecting end 312 of the second feed-in portion 31. The fourth grounding segment 322 is substantially perpendicular to and extends from the third grounding segment 321 away from the second connecting end 312 in the –y direction to connect electrically with the grounding element 1. It is noted that the fourth grounding segment 322 of the second radiating conductor 3 is proximate to the second grounding segment 222 of the first radiating conductor 2.

The second radiating portion 33 is connected electrically to and extends from the second connecting end 312 of the second feed-in portion 31 away from the second grounding portion 32.

In addition, the first grounding end 11 and the second grounding end 12 of this preferred embodiment are connected electrically to two conductive shields of two respective coaxial cables (not shown) for receiving grounding signals, respectively. The first feed-in end 211 and the second feed-in end 311 of this preferred embodiment are connected electrically to center cores of the coaxial cables for receiving the first radio frequency signal and the second radio frequency signal, respectively. Moreover, the first radiating conductor 2 of this preferred embodiment cooperates with the grounding element 1 to form an inverted-F antenna, and the second radiating conductor 3 of this preferred embodiment cooperates with the grounding element 1 to form another inverted-F antenna.

The decoupling unit 4 is connected electrically between a portion of the first radiating conductor 2 and a portion of the second radiating conductor 3 that are proximate to each other. In this preferred embodiment, the decoupling unit 4 is a decoupling capacitor (C) connected electrically between the second grounding segment 222 of the first grounding portion 22 of the first radiating conductor 2 and the fourth grounding segment 322 of the second grounding portion 32 of the second radiating conductor 3. The decoupling capacitor (C) may reduce an inductive coupling effect between the first and second radiating conductors 2, 3. In this preferred embodiment, the decoupling capacitor (C) is connected electrically between a portion of the second grounding segment 222 and a portion of the fourth grounding segment 322 that are away from the grounding element 1. However, the decoupling capacitor (C) may be connected electrically to other portions of the second and fourth grounding segments 222, 322 in other embodiments of the present invention.

Figure 2:
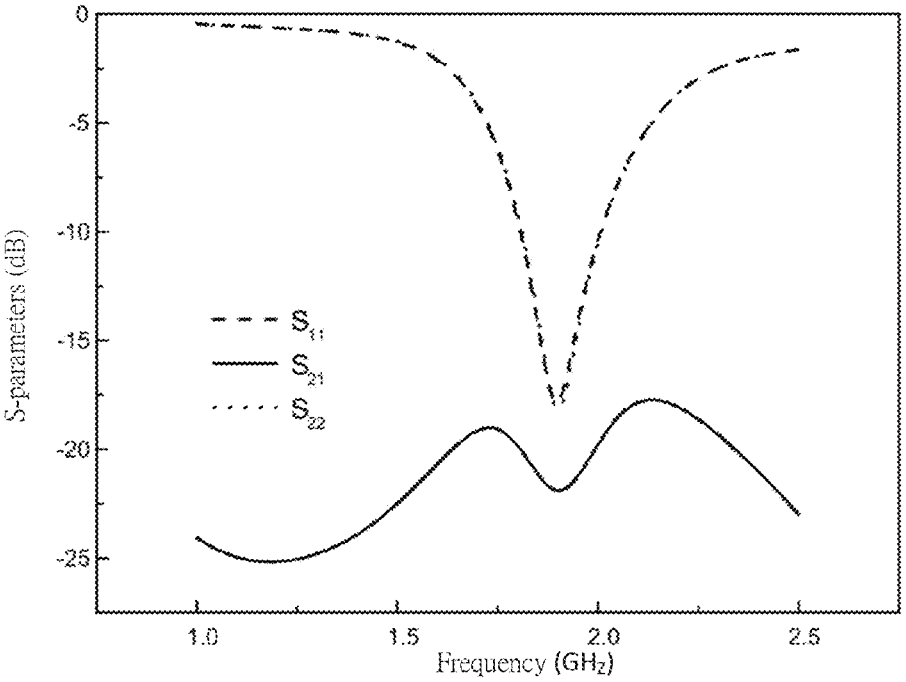
FIG. 2 is a plot showing S-parameters of the antenna module of the first preferred embodiment according to the present invention.

FIG. 2 is a plot showing S-parameters of the antenna module 100 of the first preferred embodiment according to the present invention. A curve line ($S_{11}$) indicates a return loss related to the first feed-in end 211 of the first feed-in portion 21 of the first radiating conductor 2. A curve line ($S_{22}$) indicates a return loss related to the second feed-in end 311 of the second feed-in portion 31 of the second radiating conductor 3. A curve line ($S_{21}$) indicates isolation between the first feed-in end 211 of the first radiating conductor 2 and the second feed-in end 311 of the second radiating conductor 3.

Figure 3:
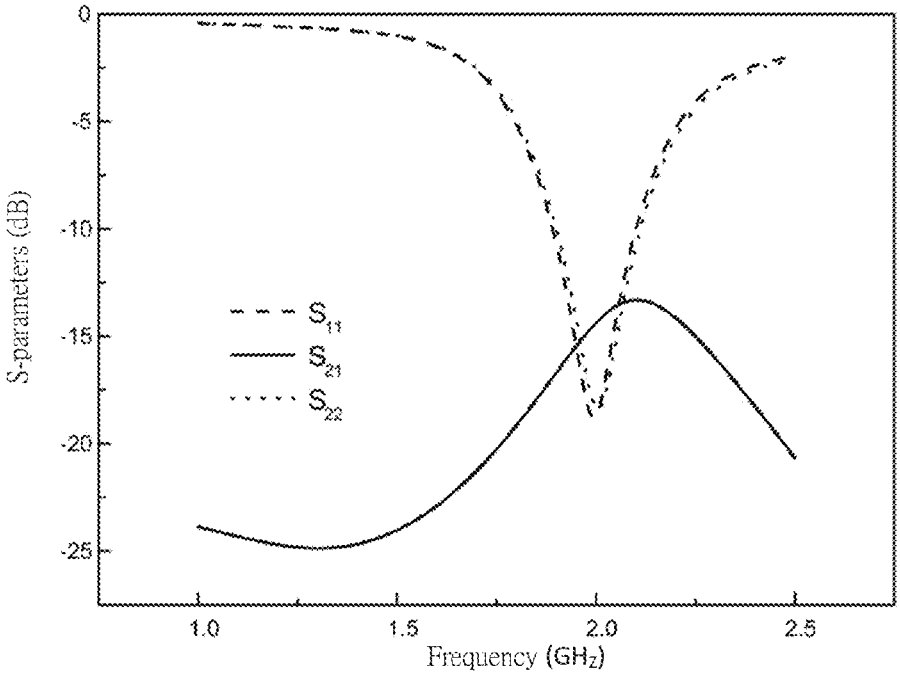
FIG. 3 is a plot showing S-parameters of an antenna module of the first preferred embodiment without a decoupling unit.

FIG. 3 is a plot showing S-parameters of an antenna module that differs from the first preferred embodiment in that the decoupling unit 4 is omitted. Comparing the curve line ($S_{21}$) of FIG. 3 with the curve line ($S_{21}$) of FIG. 2 under the frequency of around 1.9 GHz, it is evident that the decoupling unit 4 may effectively improve the isolation between the first and second radiating conductors 2, 3.

Figure 4:
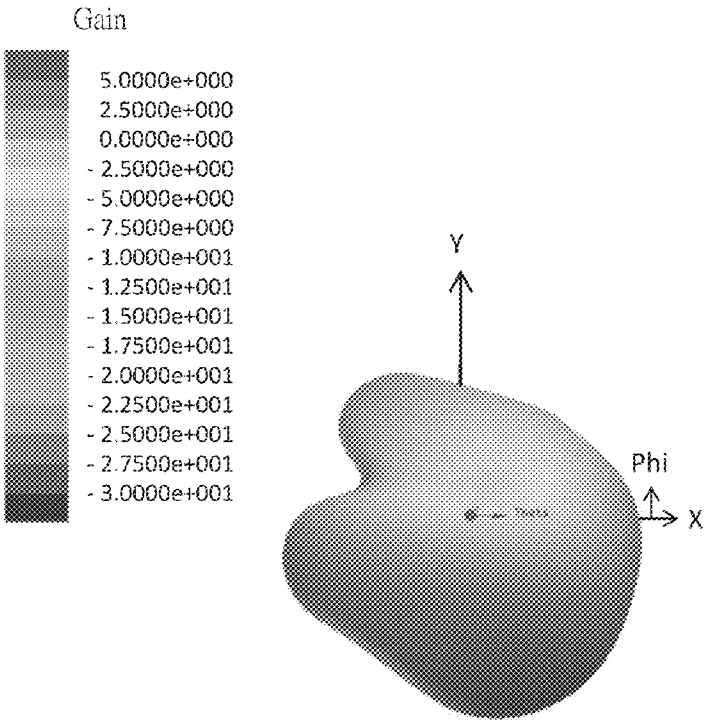
FIG. 4 is a radiation pattern of a first radiating conductor of the first preferred embodiment operating with a grounding element.
Figure 5:
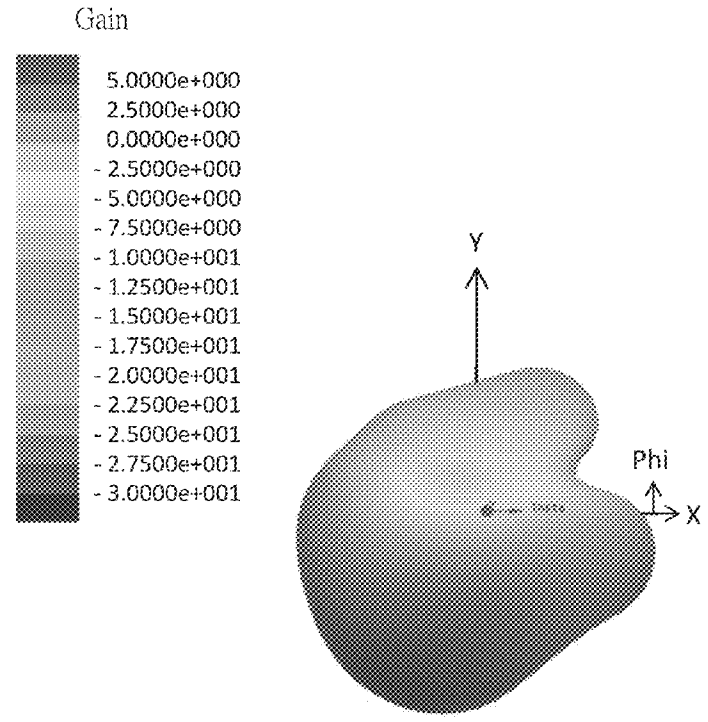
FIG. 5 is a radiation pattern of a second radiating conductor of the first preferred embodiment operating with the grounding element.

FIG. 4 is a radiation pattern of the first radiating conductor 2 operating with the grounding element 1 in the first preferred embodiment, and FIG. 5 is a radiation pattern of the second radiating conductor 3 operating with the grounding element 1 in the first preferred embodiment. The radiation pattern shown in FIG. 4 is substantially symmetrical with the radiation pattern shown in FIG. 5 about the y direction, and, correlation between the radiation patterns of the first and second radiating conductors 2, 3 is low. Therefore, the antenna module 100 of the first preferred embodiment is suitable to be applied to MIMO systems.

Figure 6:
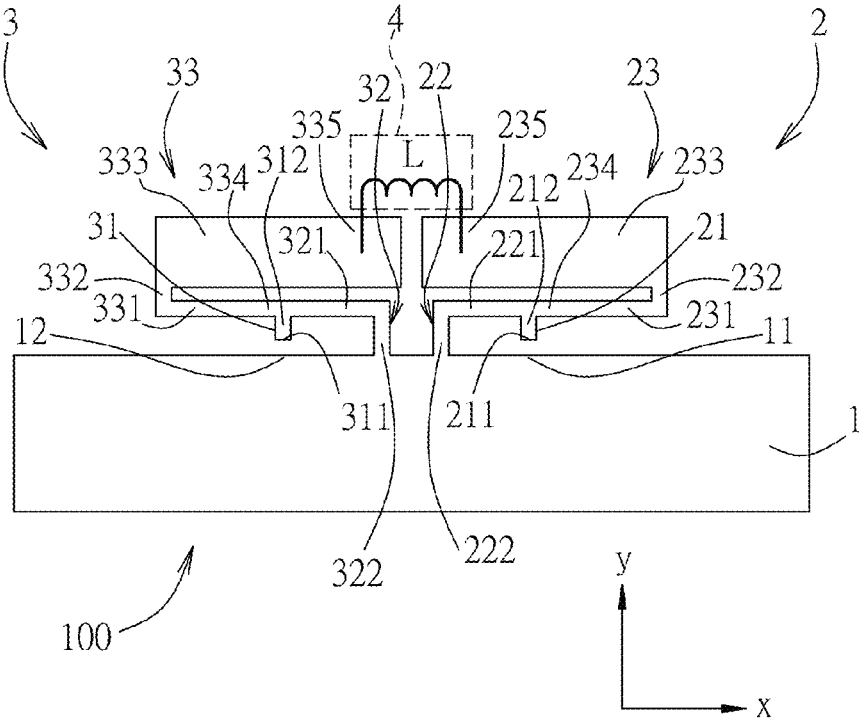
FIG. 6 is a schematic view of a second preferred embodiment of the antenna module according to the present invention.

Referring to FIG. 6, a second preferred embodiment of the antenna module 100 according to the present invention is shown to be similar to the first preferred embodiment. The differences reside in the first radiating portion 23, the second radiating portion 33 and the decoupling unit 4.

In this preferred embodiment, the first radiating portion 23 includes a first connecting segment 231, a first intermediate segment 232 and a first free segment 233. The first connecting segment 231 includes a first end part 234 connected electrically to the first connecting end 212 of the first feed-in portion 21, and extends from the first connecting end 212 of the first feed-in portion 21 in the x direction away from the second radiating conductor 3. The first intermediate segment 232 is connected electrically to the first connecting segment 231 opposite to the first feed-in portion 21, and extends in the y direction away from the grounding element 1. The first free segment 233 is connected electrically to the first intermediate segment 232 opposite to the first connecting segment 231, extends in the –x direction toward the second radiating conductor 3, and includes a second end part 235 opposite to the first end part 234.

The second radiating portion 33 includes a second connecting segment 331, a second intermediate segment 332 and a second free segment 333. The second connecting segment 331 includes a third free end part 334 connected electrically to the second connecting end 312 of the second feed-in portion 31, and extends from the second connecting end 312 of the second feed-in portion 31 in the −x direction away from the first radiating conductor 2. The second intermediate segment 332 is connected electrically to the second connecting segment 331 opposite to the second feed-in portion 31, and extends in the y direction away from the grounding element 1. The second free segment 333 is connected electrically to the second intermediate segment 332 opposite to the second connecting segment 331, extends in the x direction toward the first radiating conductor 2, and includes a fourth end part 335 opposite to the third end part 334. The second end part 235 of the first radiating portion 23 is proximate to the fourth end part 335 of the second radiating portion 33.

In this embodiment, the decoupling unit 4 is a decoupling inductor (L) that is connected electrically between the second end part 235 of the first radiating portion 23 and the fourth end part 335 of the second radiating portion 33. The decoupling inductor (L) may reduce capacitive coupling effect between the first and second radiating conductors 2, 3.

Figure 7:
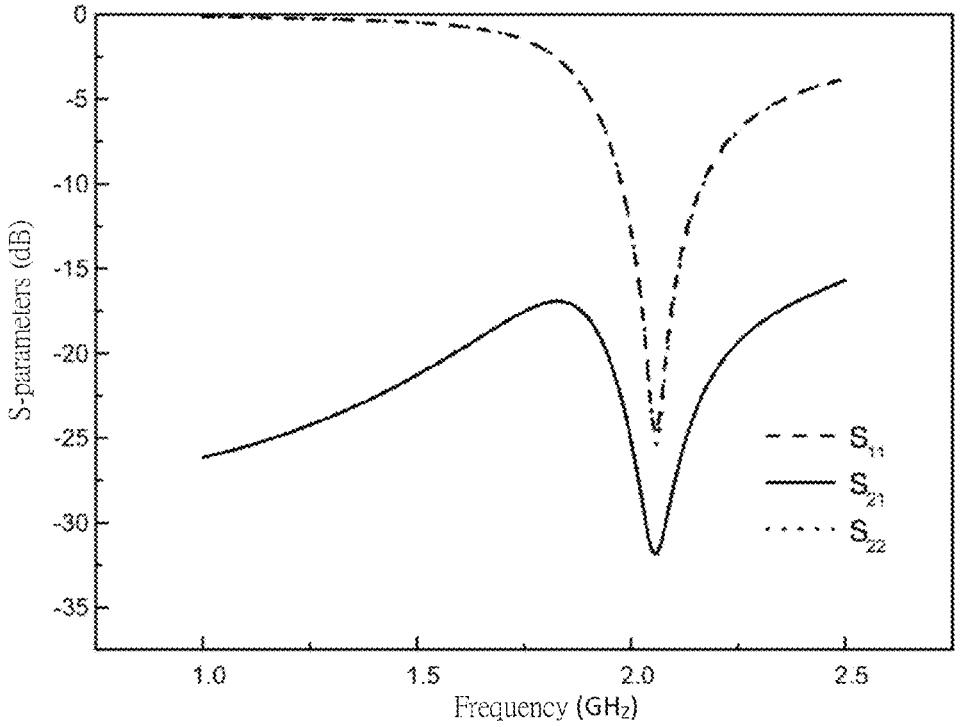
FIG. 7 is a plot showing S-parameters of the antenna module of the second preferred embodiment according to the present invention.
Figure 8:
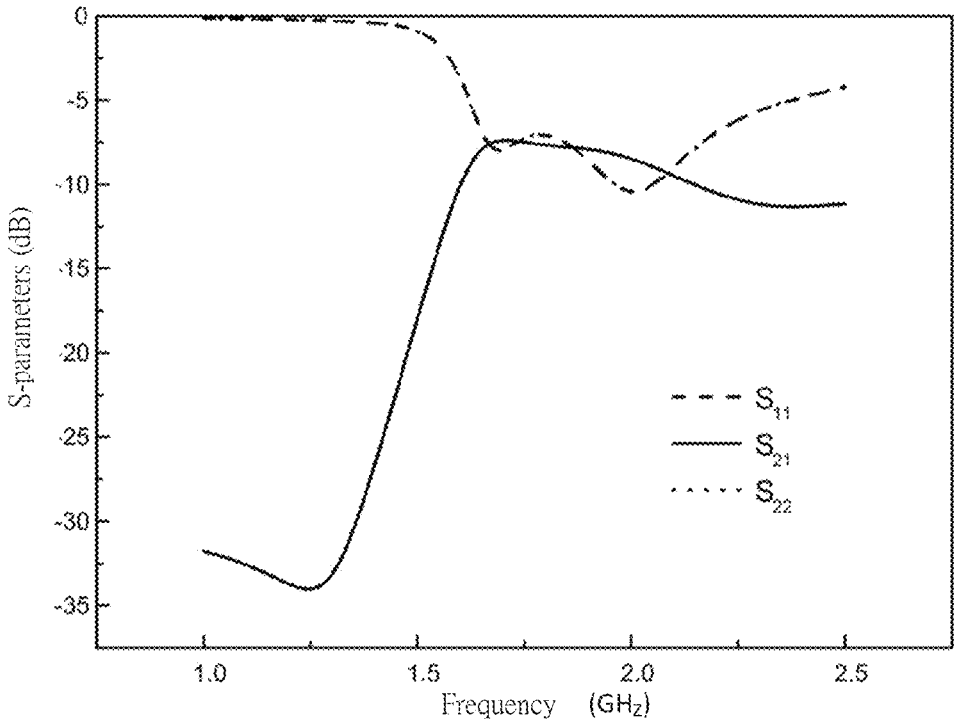
FIG. 8 is a plot showing S-parameters of another antenna module without the decoupling unit.

FIG. 7 is a plot showing S-parameters of the antenna module 100 of the second preferred embodiment according to the present invention. FIG. 8 is a plot showing S-parameters of another antenna module that differs from the second preferred embodiment in that the decoupling unit 4 is omitted. Comparing the curve line ($S_{21}$) of FIG. 7 with the curve line ($S_{21}$) of FIG. 8 under the frequency of around 2.1 GHz, it is evident that the decoupling unit 4 may effectively improve the isolation between the first and second radiating conductors 2, 3.

Figure 10:
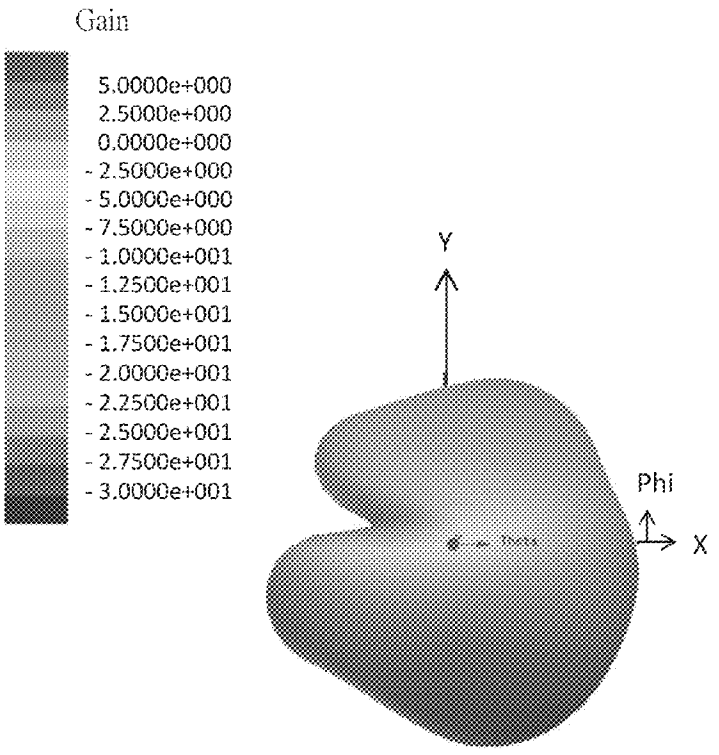
FIG. 10 is a radiation pattern of the second radiating conductor of the second preferred embodiment operating with the grounding element.
Figure 9:
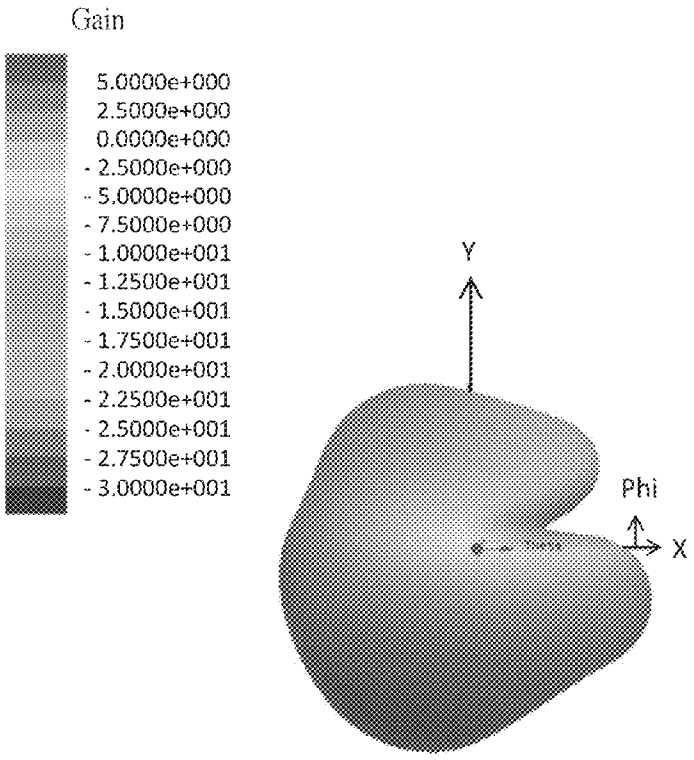
FIG. 9 is a radiation pattern of the first radiating conductor of the second preferred embodiment operating with the grounding element.

FIG. 9 is a radiation pattern of the first radiating conductor 2 operating with the grounding element 1 in the second preferred embodiment, and FIG. 10 is a radiation pattern of the second radiating conductor 3 operating with the grounding element 1 in the second preferred embodiment. The radiation pattern shown in FIG. 9 is substantially symmetrical with the radiation pattern shown in FIG. 10 about the y axis, and, correlation between the radiation patterns of the first and second radiating conductors 2, 3 is low. Therefore, the second preferred embodiment of the antenna module 100 is suitable to be applied to MIMO systems.

Figure 11:
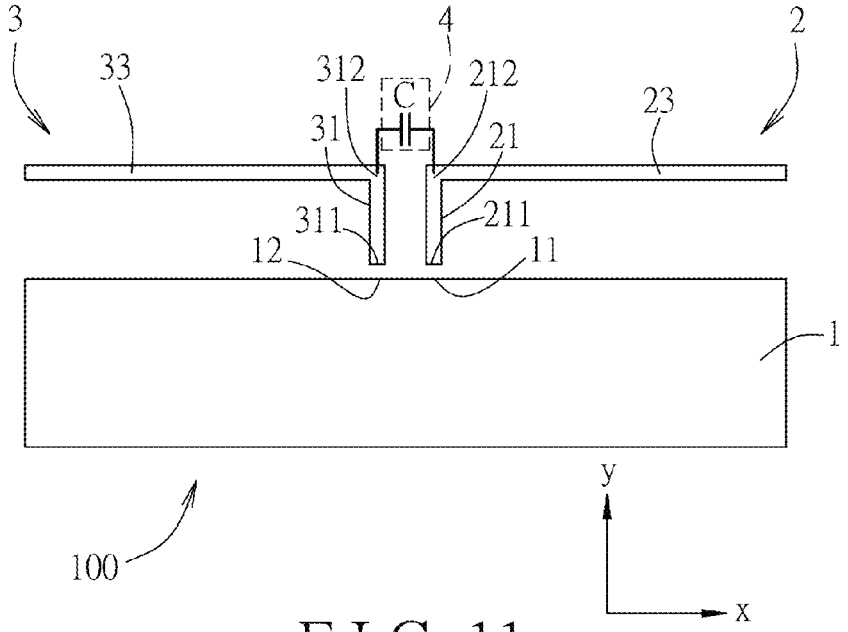
FIG. 11 is a schematic view of a third preferred embodiment of the antenna module according to the present invention.

Referring to FIG. 11, a third preferred embodiment of the antenna module 100 according to the present invention is shown to be similar to the first preferred embodiment. The major differences reside in the following. In this preferred embodiment, the first grounding portion 22 of the first radiating conductor 2 and the second grounding portion 32 of the second radiating conductor 3 are omitted. In other words, the first radiating conductor 2 and the grounding element 1 cooperatively form a monopole antenna, and the second radiating conductor 3 and the grounding element 1 cooperatively form another monopole antenna. The first feed-in portion 21 is proximate to the second feed-in portion 31 in this preferred embodiment. The decoupling unit 4 is the decoupling capacitor (C) connected electrically between the first feed-in portion 21 and the second feed-in portion 31. The decoupling capacitor (C) in this preferred embodiment is connected electrically between the first connecting end 212 of the first feed-in portion 21 and the second connecting end 312 of the second feed-in portion 31. However, the decoupling capacitor (C) may be connected electrically to other portions of the first and second feed-in portions 21, 31 in other embodiments of the present invention.

Figure 12:
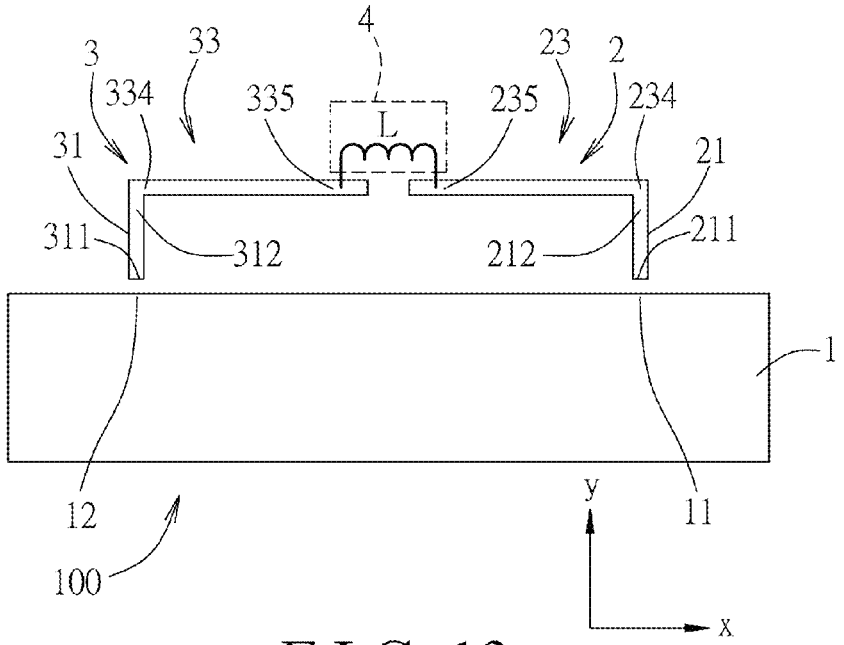
FIG. 12 is a schematic view of a fourth preferred embodiment of the antenna module according to the present invention.

Referring to FIG. 12, a fourth preferred embodiment of the antenna module 100 according to the present invention is shown. In this preferred embodiment, the first grounding portion 22 of the first radiating conductor 2 and the second grounding portion 32 of the second radiating conductor 3 are omitted. In other words, the first radiating conductor 2 and the grounding element 1 cooperatively form a monopole antenna, and the second radiating conductor 3 and the grounding element 1 cooperatively form another monopole antenna. Moreover, the first radiating portion 23 is an elongated conductor extending from the first connecting end 212 of the first feed-in portion 21 in the −x direction toward the second radiating conductor 3. The second radiating portion 33 is an elongated conductor extending from the second connecting end 312 of the second feed-in portion 31 in the x direction toward the first radiating conductor 2. Similar to the second preferred embodiment, the second end part 235 of the first radiating portion 23 in this preferred embodiment is proximate to the fourth end part 335 of the second radiating portion 33. The decoupling unit 4 is the decoupling inductor (L) connected electrically between the second end part 235 and the fourth end part 335.

To conclude, according to the present invention, the decoupling unit 4 (i.e., the decoupling capacitor (C) or the decoupling inductor (L)) of the antenna module 100 are connected electrically between the positions of the first radiating conductor 2 and the second radiating conductor 3 that are proximate to each other, such that the inductive/capacitive coupling effect between the first radiating conductor 2 and the second radiating conductor 3 may be reduced. Therefore, the isolation between the first radiating conductor 2 and the second radiating conductor 3 under operation of the antenna module 100 may be improved, and signal transmission performance may be maintained. Further, the antenna module 100 may have a relatively small size.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna module, comprising:

a grounding element including a first grounding end and a second grounding end;

a first radiating conductor including a first feed-in end that is adjacent to and spaced apart from said first grounding end of said grounding element and that is configured to be fed with a first radio frequency signal, said first radiating conductor including a first feed-in portion spaced apart from said grounding element and including said first feed-in end and a first connecting end opposite to said first feed-in end, a first grounding portion connected electrically between said grounding element and said first connecting end of said first feed-in portion, and a first radiating portion connected electrically to said first connecting end of said first feed-in portion;

a second radiating conductor adjacent to and spaced from said first radiating conductor, and including a second feed-in end that is adjacent to and spaced apart from said second grounding end of said grounding element and that is configured to be fed with a second radio frequency signal, said second radiating conductor including a second feed-in portion spaced apart from said grounding element and including said second feed-in end and a second connecting end opposite to said second feed-in end, a second grounding portion connected electrically between said grounding element and said second connecting end of said second feed-in portion and being proximate to said first grounding portion, and a second radiating portion connected electrically to said second connecting end of said second feed-in portion; and a decoupling unit connected electrically between a portion of said first radiating conductor and a portion of said second radiating conductor that are proximate to each other, and being one of a decoupling capacitor and a decoupling inductor, said decoupling unit being a decoupling capacitor connected electrically between said first grounding portion and said second grounding portion, wherein:

said first grounding portion includes a first grounding segment that extends from said first connecting end toward said second radiating conductor, and a second grounding segment that is substantially perpendicular to said first grounding segment and that is connected electrically between said grounding element and said first grounding segment;

said second grounding portion includes a third grounding segment that extends from said second connecting end toward said first radiating conductor, and a fourth grounding segment that is substantially perpendicular to said third grounding segment and that is connected electrically between said grounding element and said third grounding segment; and said decoupling unit is connected electrically between said first grounding segment and said third grounding segment.

2. The antenna module as claimed in claim 1, wherein said first and second grounding ends of said grounding element are configured to be connected electrically to two conductive shields of respective two coaxial cables for receiving ground signals, respectively.

* * * * *